US010939738B2

(12) United States Patent
Apte et al.

(10) Patent No.: US 10,939,738 B2
(45) Date of Patent: Mar. 9, 2021

(54) AUTOMATIC NAIL POLISH APPLICATION SYSTEM AND METHOD

(71) Applicant: Elementree Inc., San Francisco, CA (US)

(72) Inventors: Renuka Ajay Apte, San Francisco, CA (US); Aaron James Feldstein, San Francisco, CA (US); Erik Oscar Sunden, San Francisco, CA (US)

(73) Assignee: Elementree Inc., San Francisco, CA (US)

( * ) Notice: Subject to any disclaimer, the term of this patent is extended or adjusted under 35 U.S.C. 154(b) by 0 days.

(21) Appl. No.: 16/799,555

(22) Filed: Feb. 24, 2020

(65) Prior Publication Data

US 2020/0268125 A1 Aug. 27, 2020

Related U.S. Application Data

(60) Provisional application No. 62/810,906, filed on Feb. 26, 2019.

(51) Int. Cl.

| | |
|---|---|
| ***B41J 3/407*** | (2006.01) |
| ***B41M 1/40*** | (2006.01) |
| ***A45D 29/14*** | (2006.01) |

(52) U.S. Cl.

CPC ..... *A45D 29/14* (2013.01); *B41J 3/4073* (2013.01); *B41M 1/40* (2013.01)

(58) Field of Classification Search

None

See application file for complete search history.

(56) References Cited

U.S. PATENT DOCUMENTS

| | | | | |
|---|---|---|---|---|
| 4,855,752 | A * | 8/1989 | Bergstedt | B41J 2/2132 347/41 |
| 4,967,203 | A * | 10/1990 | Doan | B41J 2/2132 347/41 |
| 5,376,956 | A * | 12/1994 | Nagao | B41J 2/525 347/115 |
| 5,931,166 | A * | 8/1999 | Weber | A45D 29/00 132/73 |
| 5,975,677 | A * | 11/1999 | Marler | B41J 2/14024 347/40 |
| 6,033,064 | A * | 3/2000 | Pawlowski, Jr. | B41J 2/175 347/87 |
| 6,035,860 | A * | 3/2000 | Mombourquette | A45D 29/00 132/200 |
| 6,053,601 | A * | 4/2000 | Watanabe | B41J 2/14274 347/70 |
| 6,286,517 | B1 * | 9/2001 | Weber | A45D 29/00 132/73 |
| 6,336,694 | B1 * | 1/2002 | Ishizaka | A45D 29/00 347/105 |
| 6,525,724 | B1 * | 2/2003 | Takami | A45D 29/00 345/418 |

(Continued)

OTHER PUBLICATIONS

International Search Report and Written Opinion, Patent Cooperation Treaty Application No. PCT/US2020/019555, dated Apr. 27, 2020, 15 pages.

*Primary Examiner* — Ted W Barnes

(74) *Attorney, Agent, or Firm* — Fenwick & West LLP

(57) ABSTRACT

The present disclosure relates to a robotic apparatus and methods for automatic nail polish application on natural or artificial finger or toe nails.

20 Claims, 13 Drawing Sheets
(3 of 13 Drawing Sheet(s) Filed in Color)

(56) References Cited

U.S. PATENT DOCUMENTS 9,357,825 B2 * 6/2016 Yamasaki ..... A45D 29/00
9,462,869 B2 * 10/2016 Bitoh ..... A45D 29/00
9,475,308 B2 * 10/2016 Legallais ..... B41J 3/46
9,486,050 B2 * 11/2016 Yamasaki ..... G06T 11/203
9,510,658 B2 * 12/2016 Nagao ..... G06K 9/00362
9,526,313 B2 * 12/2016 Asako ..... A45D 29/00
9,603,431 B2 * 3/2017 Nagao ..... G06K 9/00375
9,635,923 B2 * 5/2017 Bitoh ..... A45D 29/00
9,642,436 B2 * 5/2017 Miyamoto ..... B41J 3/407
9,675,159 B2 * 6/2017 Bitoh ..... A45D 29/00
9,712,727 B2 * 7/2017 Yamasaki ..... A45D 29/00
9,743,740 B2 * 8/2017 Teshima ..... G06T 7/73
9,799,116 B2 * 10/2017 Kafuku ..... A45D 29/00
9,808,068 B2 * 11/2017 Yamasaki ..... A45D 29/00
9,820,547 B2 * 11/2017 Yamasaki ..... A45D 44/005
9,894,976 B2 * 2/2018 Shimizu ..... G06T 11/20
9,894,978 B2 * 2/2018 Nagao ..... B43L 13/024
9,901,156 B2 * 2/2018 Nagao ..... A45D 34/04
9,930,951 B2 * 4/2018 Nagao ..... A45D 29/00
9,943,154 B2 * 4/2018 Teshima ..... B41J 3/407
9,943,155 B2 * 4/2018 Hori ..... B41J 3/407
9,955,764 B2 * 5/2018 Yoshigai ..... A45D 34/04
10,022,984 B2 * 7/2018 Irie ..... A45D 34/04
10,029,477 B2 * 7/2018 Yamasaki ..... B41J 3/407
10,130,154 B2 * 11/2018 Irie ..... A45D 29/00
10,278,472 B2 * 5/2019 Yamasaki ..... H04N 5/23229
10,292,475 B2 * 5/2019 Yamasaki ..... G06K 15/021
10,404,890 B2 * 9/2019 Cao ..... G06F 30/00
2006/0036415 A1 * 2/2006 Nielson ..... A45D 31/00 703/2
2007/0092634 A1 * 4/2007 Zhang ..... B41J 3/4073 427/1
2012/0103210 A1 * 5/2012 Hashimoto ..... B41J 3/407 101/35
2012/0147113 A1 * 6/2012 Yamasaki ..... A45D 29/00 347/104
2012/0287183 A1 * 11/2012 Bitoh ..... B41J 2/2117 347/3
2013/0019799 A1 * 1/2013 Bitoh ..... B41J 3/407 118/300
2013/0038648 A1 * 2/2013 Kasahara ..... B41J 3/407 347/2
2013/0106970 A1 * 5/2013 Yamasaki ..... B41J 3/46 347/110
2015/0062216 A1 * 3/2015 Yamasaki ..... B41J 2/49 347/9
2015/0335131 A1 * 11/2015 Ortiz ..... A45D 29/004 132/73.6
2016/0183657 A1 * 6/2016 Nagao ..... A45D 29/00 132/200
2016/0345708 A1 * 12/2016 Walia ..... H04N 1/4092
2016/0353859 A1 * 12/2016 Melul ..... A45D 34/042
2017/0215550 A1 * 8/2017 Walia ..... A45D 44/005
2019/0084331 A1 * 3/2019 Kasahara ..... B41J 3/407
2019/0095747 A1 * 3/2019 Sasaki ..... G06T 7/136
2019/0191845 A1 * 6/2019 Sasaki ..... A45D 29/14
2019/0313765 A1 * 10/2019 Leong ..... G06F 3/13
2020/0205549 A1 * 7/2020 Mor Yosef ..... A45D 29/00

* cited by examiner

ISOMETRIC VIEW

SIDE VIEW

AUTOMATIC NAIL POLISH APPLICATION SYSTEM AND METHOD

RELATED APPLICATION

This application claims priority to U.S. Provisional application No. 62/810,906 filed on 26 Feb. 2019 which is incorporated by reference herein in its entirety.

FIELD

The present disclosure relates to systems and methods for automatic nail polish applications and more particularly for automatically identifying a target nail polish application location, automatically adjusting for movement at the target location and automatically applying nail polish to the target nail polish location.

BACKGROUND

Conventionally painting nails involves using a brush with flexible bristles that is dipped into a bottle of nail polish and used to paint natural or artificial nails. It involves a high degree of precision and accuracy on the part of a human to apply a smooth coat of nail polish on nails while staying within the boundaries of the nail. The high degree of precision and accuracy required has posed a challenge to mechanizing the painting of nails. Conventional robotic methods have been unable to replicate the accurate and smooth coats of nail polish achievable by humans.

SUMMARY

The present disclosure relates to a robotic apparatus and methods for automatic nail polish application on natural or artificial finger or toe nails. In some embodiments, the robot uses artificial intelligence (AI) to identify and paints the nails. The robot uses depth sensors and computer vision to plan the movements of an end-effector. In one embodiment, the robot uses AI and machine learning techniques such as deep reinforcement learning, and other algorithms and calculations to plan its path. An AI controller can be trained using OpenAI's Gym or DeepMind's TRFL libraries. The robotic apparatus may use the following embodiments of a robotic nail painting method to apply nail polish, for example.

In one embodiment, a polish reservoir with an opening may use pressure, a plunger or gravity to deposit a measured amount of polish on the nail. Multiple such depositions in close proximity are used to create a smooth, uniform coat on a single nail.

In another embodiment, a mask, that can be peeled off, is placed on the skin surrounding the nail and optionally the cuticles, and a fine, controlled spray of nail polish that is deposited directly on a person's natural or artificial nails.

Notably, these methods do not require the application of any adhesive coats or primers on the nail prior to application.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

Embodiments are described below. It is, however, expressly noted that the present invention is not limited to these embodiments, but rather the intention is that variations, modifications, and equivalents that are apparent to the person skilled in the art are also included.

Components

In one embodiment, the robot comprises the following physical components: an area designated for the user to place their hands/feet, one or more polish cartridges, an end effector, a motion platform, a storage for one or more cartridges of nail polish, an interface, and one or more sensors, e.g., cameras. The robot also includes, and/or can communicate with, sensors, an electronic storage device, a processor along with software, firmware, and/or hardware, for example, to perform operations described herein including analyzing sensor data. One familiar in the art will recognize various embodiment may comprise additional or fewer components.

Figure 1A:
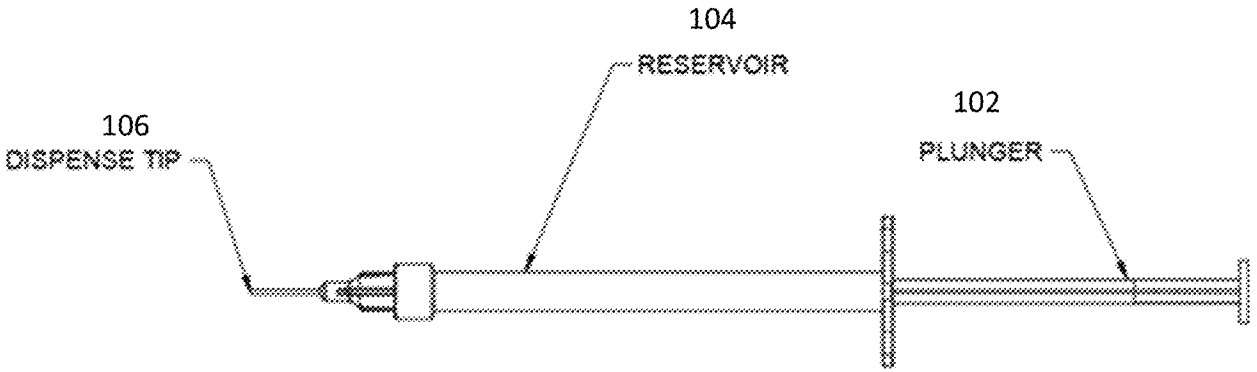
FIG. 1A is an illustration of a cartridge in accordance with an embodiment.

The cartridge includes one or more reservoirs that can hold clear and/or colored nail polish and a nozzle from which the polish is dispensed. The cartridge is initially filled with polish and then may be sealed by various techniques such as overmolding, capping, or inserting a plunger. Overmolding to seal the reservoir is performed by flowing another material onto the opening of the reservoir, thereby sealing it with a material such as rubber or a thermoplastic, for example. To cap seal the cartridge, an adhesive and covering material are used in tandem to create an airtight seal. To seal the cartridge using a plunger, a plunger style device is inserted into the open end until all trapped air is expelled through the dispense tip. In the embodiment of the cartridge shown in FIG. 1A, the cartridge includes three main components: a dispense tip 106 with a precise orifice, a reservoir 104 for holding a fluid (e.g., nail polish), and a plunger 102 or mechanism that creates pressure. In the event of clogs, a number of techniques such as wiping or drilling the obstructing material, dipping the tip into solvent or using pressure to expel the clog can be used to unclog it.

Figure 1C:
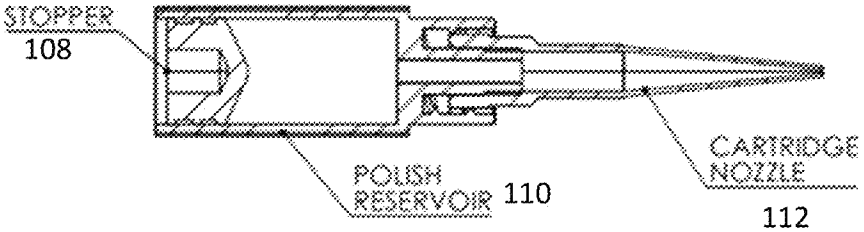
FIGS. 1B and 1C are illustrations of a cartridge in accordance with an embodiment.
Figure 1B:
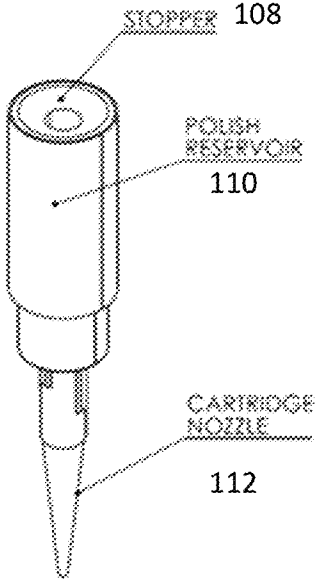

FIGS. 1B and 1C are illustrations of another embodiment of a cartridge that includes a stopper 108, a polish reservoir 110 and a cartridge nozzle 112.

Figure 2B:
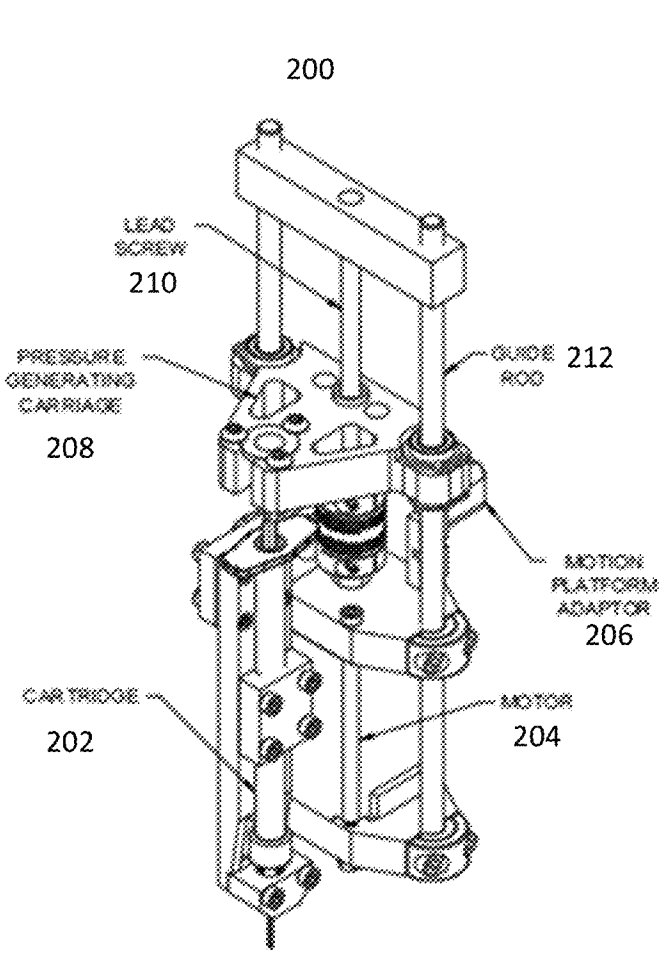
FIG. 2B is an illustration of an end effector holding a cartridge in an isometric view in accordance with an embodiment.
Figure 2A:
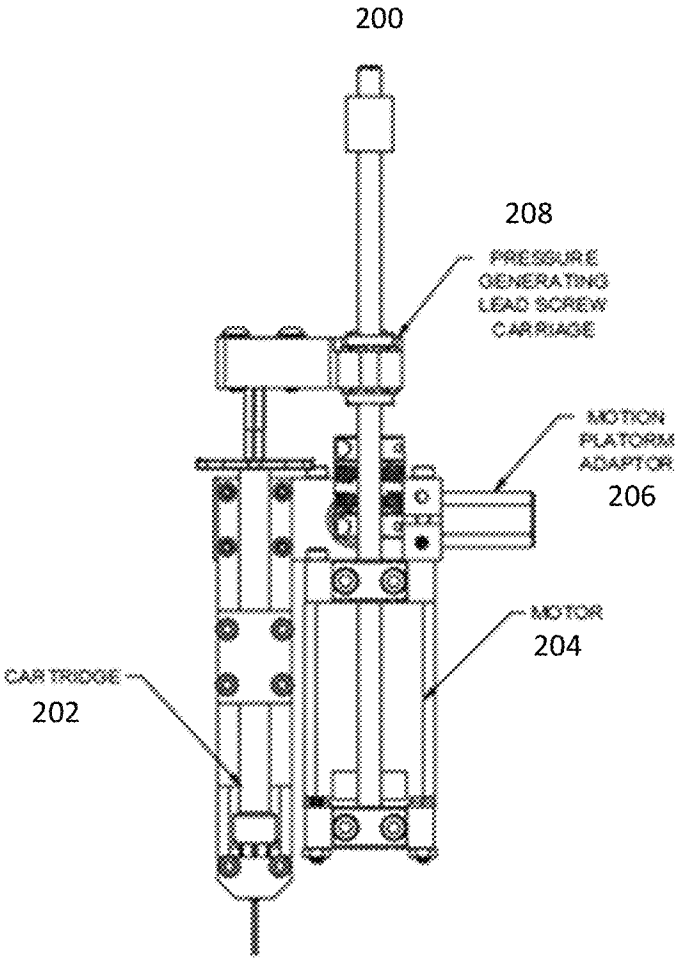
FIG. 2A is an illustration of an end effector holding a cartridge in side view in accordance with an embodiment.
Figure 2D:
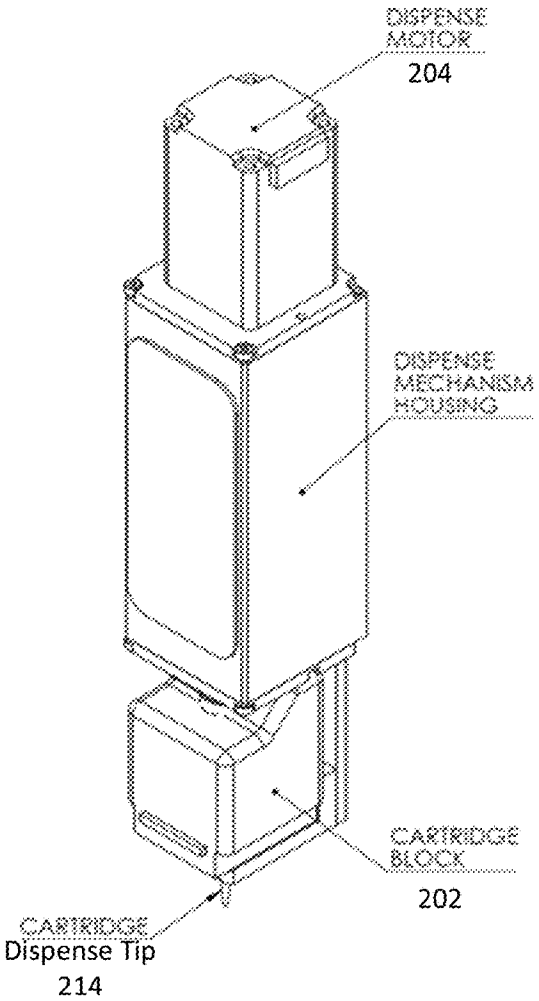
FIGS. 2C and 2D are illustrations of an end effector holding a cartridge in accordance with an embodiment.
Figure 2C:
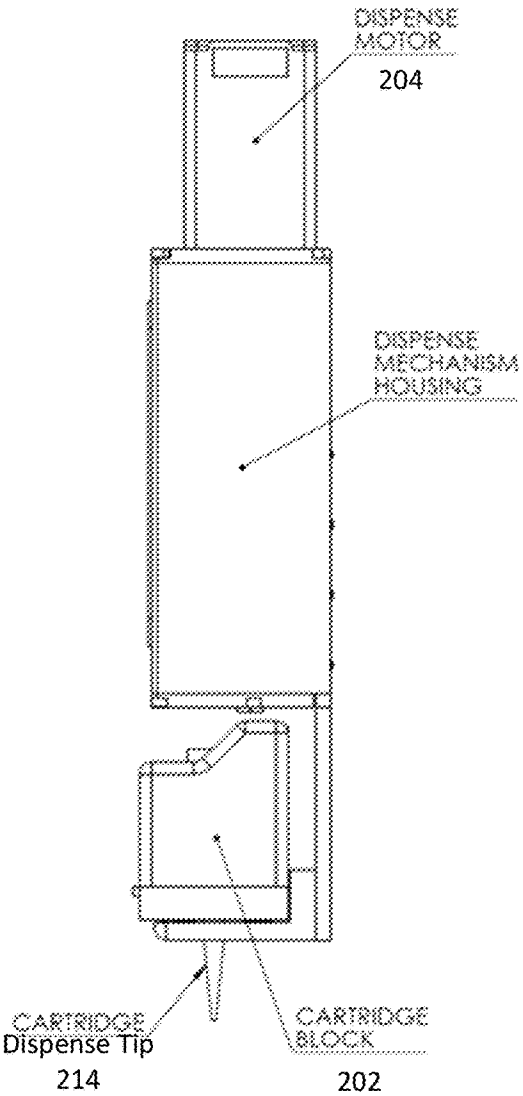

The end-effector holds the cartridges. FIGS. 2A and 2B are illustrations of an end effector 200 holding the cartridge 202 in side view (FIG. 2A) and isometric view (FIG. 2B), according to one embodiment. Nail polish is dispensed from the cartridge 202 at a controlled rate. Controlling the end effector 200 to dispense nail polish at a controlled rate can be accomplished by various techniques such as using pressure, mechanical plunger motion, or gravity, for example. A controlled flow of polish can be generated by increasing the pressure inside the reservoir, for example, by allowing an outside higher-pressure source to enter the reservoir, thereby causing the polish to flow from the dispense tip until the pressure reaches an equilibrium. The flow rate can also be controlled by a motor 204, where a rotary motor creates linear motion using, for example, a lead screw 210 and nut rigidly housed in a carriage 208, and that linear motion is then coupled to the plunger. The volumetric flow rate from the dispense needle is the rate of linear motion times the cross-sectional area of the reservoir. A third method of creating a controlled flow is to use gravity if the topside of the reservoir is opened or pierced, allowing ambient pressure to enter the topside of the container allowing polish to flow from the dispense tip 214. In an embodiment the end effector also includes a guide rod 212.

Figure 3A:
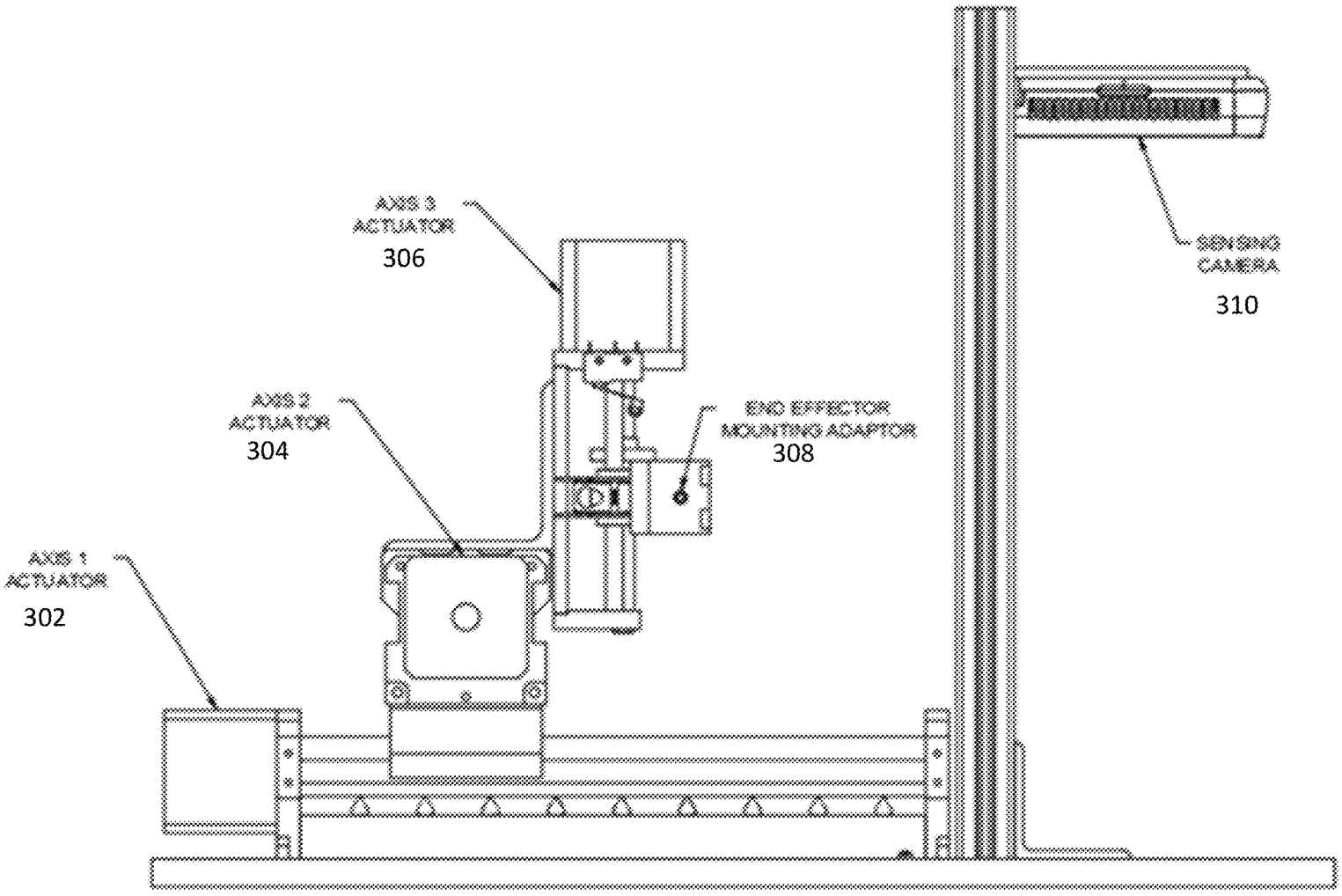
FIG. 3A is an illustration of a motion platform in accordance with an embodiment.

A motion platform 300 is used to move the end effector 200 to the desired location where the nail polish must be deposited. FIG. 3A is an illustration of a motion platform 300 in accordance with an embodiment. In this embodiment, the motion platform 300 is a 3-axis gantry system whose linear actuators may be belt, lead screw or rack and pinion driven. The actuators (302, 304, 306) for each axis are driven by stepper motors which turn lead screws. Lead screw nuts propel the transport carriages that in turn support the additional axes. At the moving side of axis 3, an attachment point 308 allows for the mounting of the end effector 200 holding the cartridge 202. The sensing camera 310, held in place above the work area, identifies the finger nails on the hand placed beneath it and directs the axes where to move.

Figure 3B:
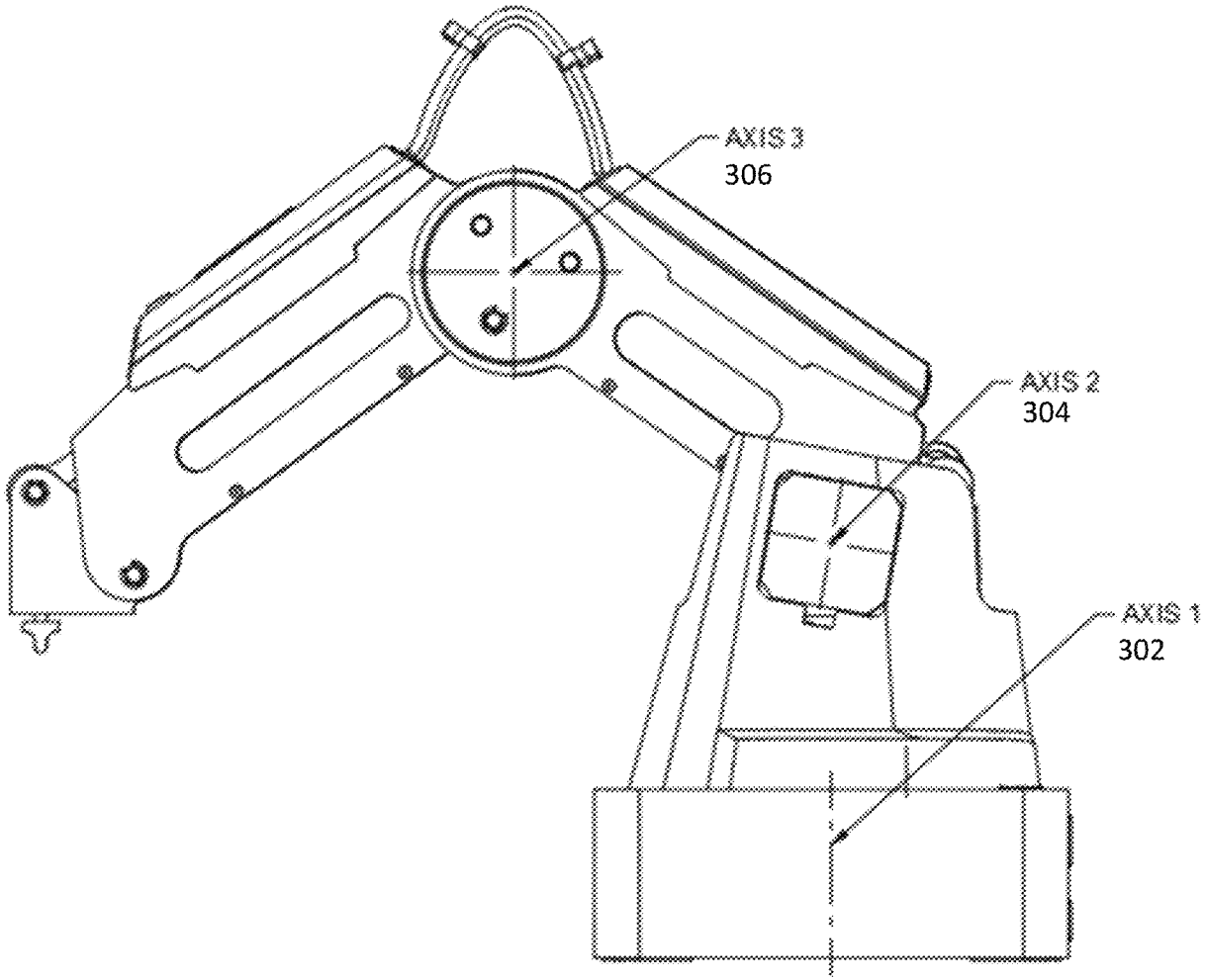
FIG. 3B is an illustration of a motion platform in accordance with another embodiment.

FIG. 3B is an illustration of a motion platform 300 in accordance with another embodiment. In this embodiment, the motion platform 300 is a robot arm that can move in three dimensions using an axis 1 actuator 302, an axis 2 actuator 304, and an axis 3 actuator 306.

The interface allows the user to send instructions to the robot. In one embodiment, the interface takes the form of one or more of: one or more buttons on the apparatus, a digital instruction interface on the apparatus, and/or a client device that can be connected to the apparatus, e.g., an application (app) that can be accessed from a mobile device, e.g., phone, watch, computer, tablet, wearable, computing device, etc.

The one or more sensors 310, e.g., cameras, capture input to be used to control the operation of the apparatus. In one embodiment, the sensors 310 are used to locate the user's hands or feet and ensure the user's hand or feet are properly positioned in the designated region. When applicable, the sensors 310 determine if the nails are bare or already coated in nail polish. In one embodiment, the sensor 310 identifies the nail based on machine learning, e.g., by using training data that identifies nails from many different users. Once the nail is identified, the color or other characteristic, e.g., reflectivity, on the nail is analyzed to determine if the nail is bare or is already coated in nail polish. Input from the sensors 310 is used by the robot to determine the depth and location of the user's nails, particularly for operation of the motion of the robot and determining whether it is safe for the robot to continue operation.

In some embodiments of the robot, sensors 310 can include one or more of: one or more cameras, LIDAR, laser triangulation, time of flight sensors, pressure or touch sensors, etc. These sensors 310 may be used to sense the operating environment of the robot and to help determine its next step. In particular, one or a combination of sensors may be used for safety features like a stopping operation when the hand or nail has moved, by detecting a change in distance or angle of the nail to the sensor, for example. The robot may also have a waste area to dispose of excess polish, cartridges, etc.

Process

In one embodiment, the robotic nail painting process begins with the user using the interface to select the clear or color cartridges of their choice and choosing a plan/type of treatment (type of manicure/art) for the robot painting the nail. Examples of plans include, but are not limited to: applying a standard manicure (clear base coat, one or more coats of the same color, and a clear top coat), applying a French manicure, and applying multiple colors.

Figure 4B:
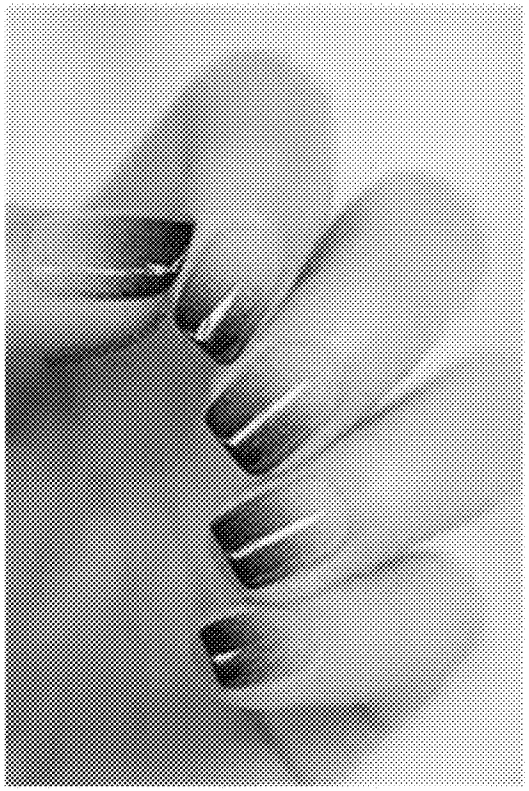
FIG. 4B is an image showing a two-tone horizontal blended nail art polish in accordance with an embodiment.
Figure 4A:
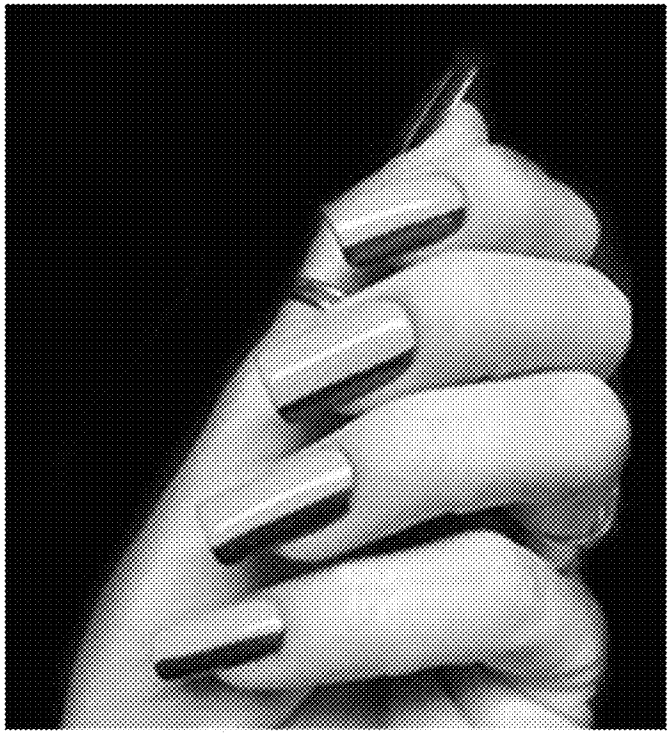
FIG. 4A is an image showing a two-tone vertical split nail art polish in accordance with an embodiment.
Figure 4D:
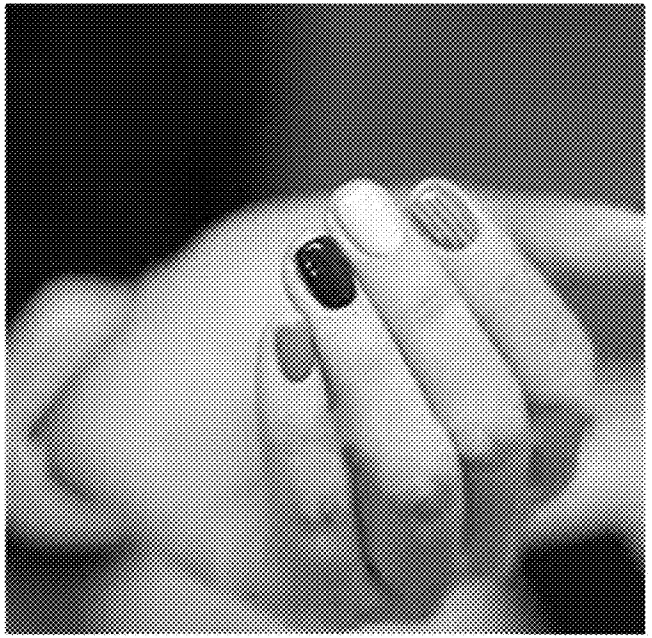
FIG. 4D is an image showing nails with different colors in accordance with an embodiment.
Figure 4C:
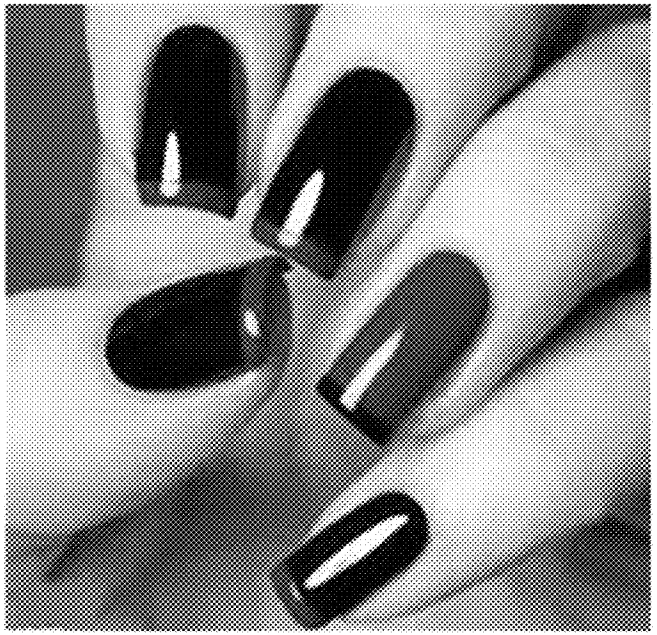
FIG. 4C is an image showing nails with colored tips in accordance with an embodiment.
Figure 4F:
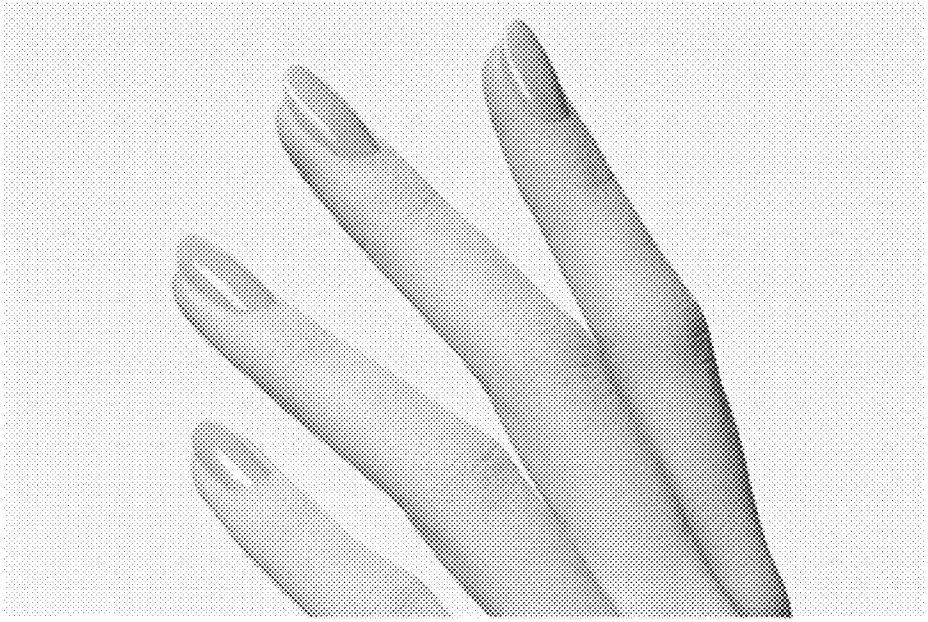
FIG. 4F is an image showing nails with regular lacquer in accordance with an embodiment.
Figure 4E:
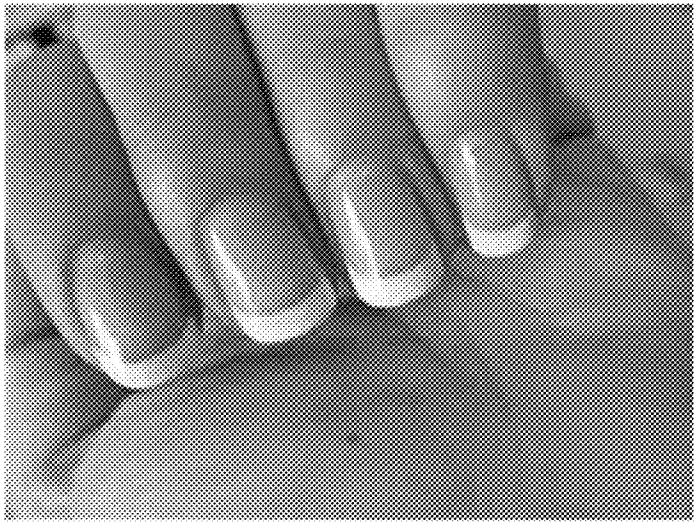
FIG. 4E is an image showing nails with a French manicure in accordance with an embodiment.

FIG. 4A is an image showing a two-tone vertical split nail art polish in accordance with an embodiment. FIG. 4B is an image showing a two-tone horizontal blended nail art polish in accordance with an embodiment. FIG. 4C is an image showing nails with colored tips in accordance with an embodiment. FIG. 4D is an image showing nails with different colors in accordance with an embodiment. FIG. 4E is an image showing nails with a French manicure in accordance with an embodiment. FIG. 4F is an image showing nails with regular lacquer in accordance with an embodiment.

Figure 5:
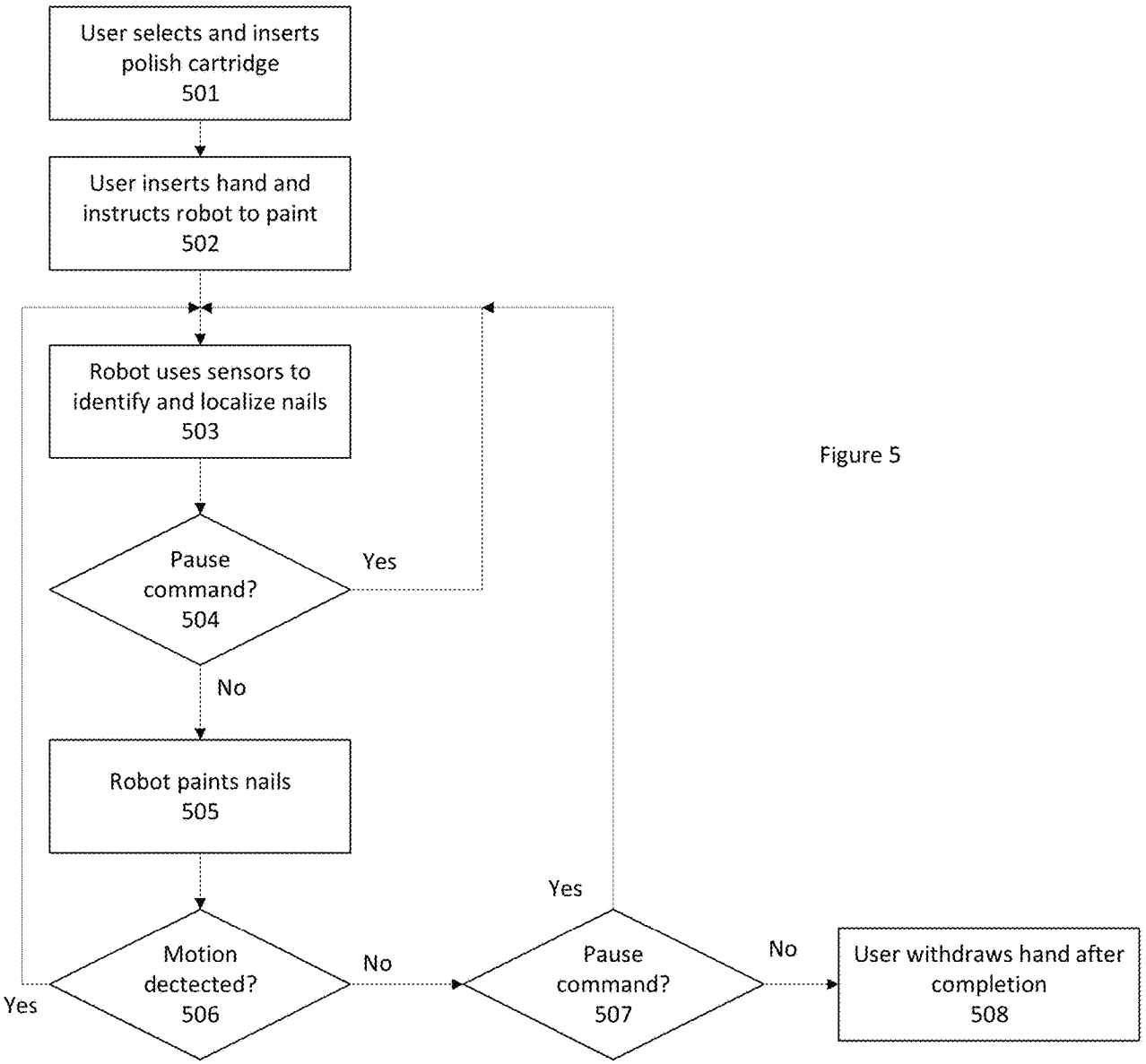
FIG. 5 is a flowchart showing the method of operation of the robot in accordance with an embodiment.

FIG. 5 is a flowchart showing the method of operation of the robot in accordance with an embodiment. In one embodiment, the user inserts 501 the cartridges into the apparatus, places 502 their hand(s) or foot/feet in the designated area, and instructs the robot to begin painting using the interface.

In an alternate embodiment, the robot installs cartridges automatically. The robot selects (e.g., picks up) the cartridge 202 needed to paint the nail and positions the cartridge 202 in the proper location in the end-effector 200. In one example, the robot locates the cartridge by using a camera and computer vision. Alternatively, the robot may retrieve the cartridge deterministically from a fixed location, that is, each type of cartridge is positioned in a defined location. This may be in response to the user selecting a type of nail treatment.

The robot creates a representation of the location of the user's nails using sensors 310. The representation may be created by a representation module in the software that controls the robot. The software controlling the software and/or processor may be stored/positioned in the robot, near the robot or may be remote from the robot, e.g., across the room or far from the robot using cloud computing. In one embodiment, the robot uses a depth sensing camera that uses binocular vision and/or structured light for depth sensing and produces the representation in 3D spatial coordinates. In one embodiment, the robot uses 503 the camera(s) and software, e.g., machine learning or artificial intelligence software, to identify nails and determine what parts of the camera frame correspond to the parts that need to be painted. An embodiment of an AI to detect nails could be a convolutional neural network based on image segmentation models from the Facebook Detectron or TensorFlow model zoos and trained on human labeled images.

The representation of the user's nails is an input to the motion planner. The motion planner is a software component that controls the motion of the robot, e.g., the motion of the motion platform, end effector, and/or cartridge. In some embodiments, the motion planner uses a combination of deep reinforcement learning, mathematical transformations, computer vision, and AI to plan the path that the motion platform must take to accomplish the goal of painting the nails. The motion planner is a real-time component, meaning it can adjust the planned path as it performs its operations and senses the environment. The motion planner may use a calibration created at run-time or in the factory to convert camera positions into coordinates that can be used by the motion platform. The robot paints 505 the nails in accordance with the selected type of nail treatment. A user has the option to pause 504/507 the operation of the robot at any time. When the user un-pauses the robot identifies 503 the location of the nails and the painting 505 continues. If the robot detects 506 motion of the nails, the robot pauses operation to ensure the safety of the user and proper application of the polish. When the user is ready to resume, the robot identifies 503 the location of the nails and the painting 505 continues. Determining the motion of the hands or nails can be determined by determining a first position of the hand/nail and then a second position of the hand/nail at a later time. If the distance between the first and second position exceeds a threshold then the system determines that the hand/nail has moved. Alternatively, a first image of the target location at a first time can be compared to a second image at a second time and if a comparison of pixels indicates movement of the hand/nail above a threshold then the system determines that the hand/nail has moved.

Figure 6A:
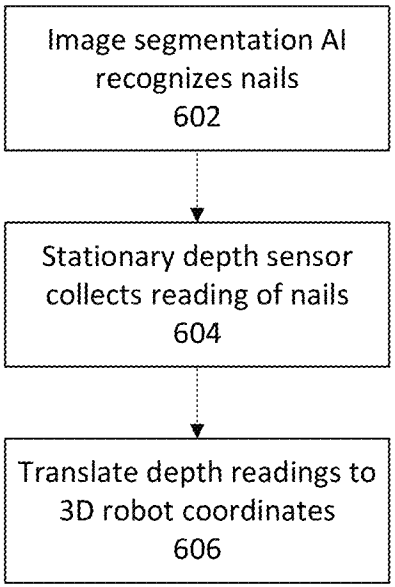
FIG. 6A is a flowchart of one method for identifying and localizing the nails using a stationary fine three-dimensional (3D) sensor.
Figure 6B:
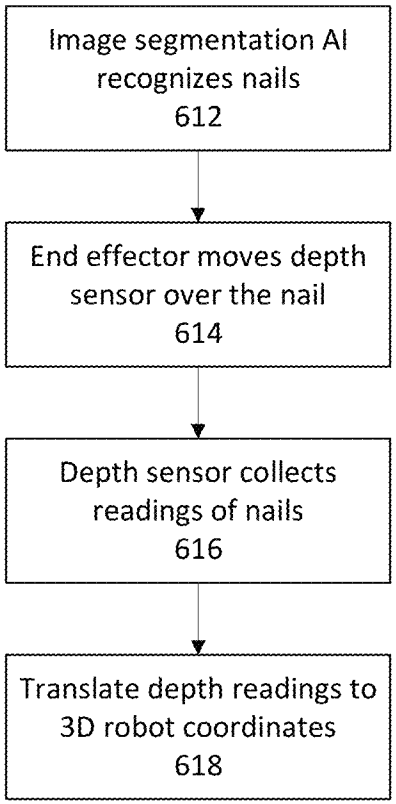
FIG. 6B is a flowchart of one method for identifying and localizing the nails using a fine three-dimensional (3D) sensor mounted to an end effector.
Figure 6C:
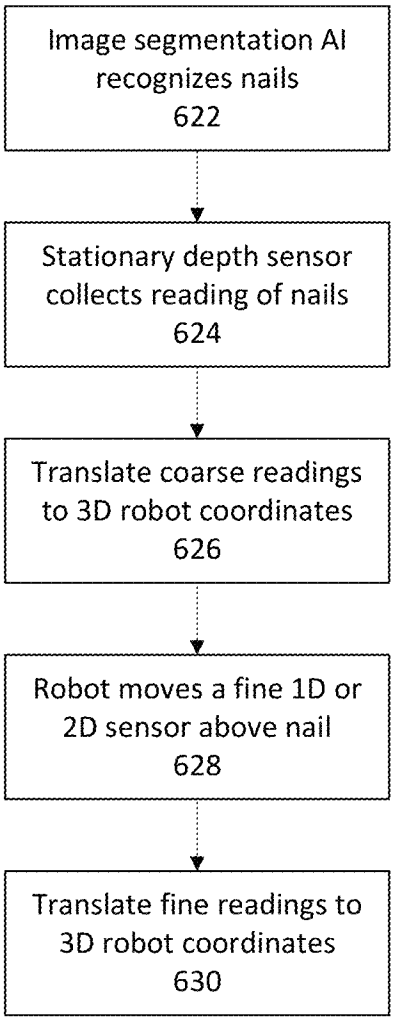
FIG. 6C is a flowchart of one method for identifying and localizing the nails using a coarse three-dimensional (3D) sensor and a fine one-dimensional (1D) and/or two-dimensional (2D) sensor.

In step 503 the robot creates a high-resolution 3D representation of the user's nails using a variety of sensors. FIGS. 6A-C are flowcharts of three methods for identifying 503 the nails. FIG. 6A is a flowchart of one method for identifying and localizing the nails using a stationary fine three-dimensional (3D) sensor 310. In this method the sensor image from the sensor 310 is received by the nail identification software. The nail identification software recognizes 602 nails using image segmentation artificial intelligence (AI) analysis. A stationary depth sensor collects 604 readings of the nail(s) and the depth sensor readings are translated 606 into three-dimensional robot coordinates, e.g., coordinates that are understood by the software operating the movement of the robot.

FIG. 6B is a flowchart of one method for identifying and localizing the nails using a fine three-dimensional (3D) sensor 310 mounted to an end effector. In this method the sensor image from the sensor 310 is received by the nail identification software. The nail identification software recognizes 612 nails using image segmentation artificial intelligence (AI) analysis. The end-effector 200 moves 614 the depth sensor over the nail. The depth sensor collects 616 readings of the nail(s) and the depth sensor readings are translated 618 into three-dimensional robot coordinates, e.g., coordinates that are understood by the software operating the movement of the robot.

FIG. 6C is a flowchart of one method for identifying and localizing the nails using a coarse three-dimensional (3D) sensor 310 and a fine one-dimensional (1D) and/or two-dimensional (2D) sensor. This method can be used in the situation where a precision is better accomplished using a one-dimensional or two-dimensional finer sensor with a lower precision three-dimensional sensor providing guidance for the finer sensor to reach the target location. In this method the sensor image from the sensor 310 is received by the nail identification software. The nail identification software recognizes 622 nails using image segmentation artificial intelligence (AI) analysis. A stationary depth sensor collects 624 readings of the nail(s) and the coarse depth sensor readings are translated 626 into three-dimensional robot coordinates, e.g., coordinates that are understood by the software operating the movement of the robot. The robot moves 628 a fine one-dimensional or two-dimensional sensor above the nail and the sensor data are used to translate 630 the fine readings to three-dimensional robot coordinates.

One embodiment of the step of painting nails 505 involves depositing a measured amount of nail polish uniformly on top of the nail surface in order to create a smooth coat. FIG. 7A is a flowchart of a Pointillist technique for painting nails in accordance with an embodiment. The dispensing motor continuously creates 702 a steady pressure on the polish reservoir. The 3D sensor location is translated 704 to 3D dispensing tip positions. If the operation is resuming from an interrupt, e.g., a pause caused by a request, nail/hand movement, and/or safety concerns, the past points are aligned 706 with sensor data to identify the starting/continuing point. The robot moves 708 the dispensing tip to closely spaced locations around the nail contour. Drops of polish coalesce 710 with neighboring drops to create a smooth coat.

Figure 7B:
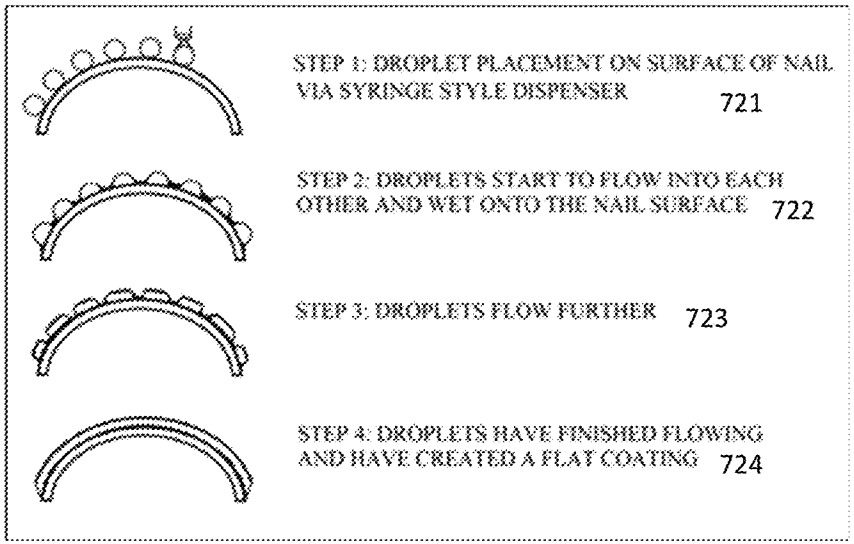
FIG. 7B is a detailed flowchart of a Pointillist technique for painting nails in accordance with an embodiment.
Figure 7A:
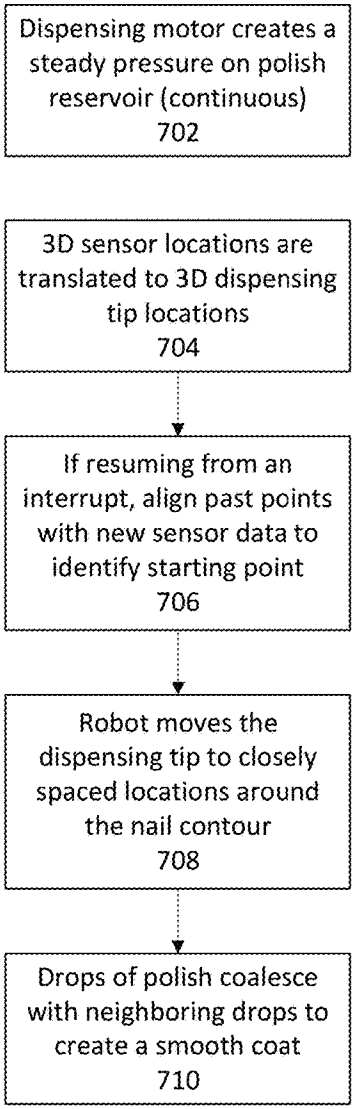
FIG. 7A is a flowchart of a Pointillist technique for painting nails in accordance with an embodiment.

Steps 708 and 710 of the "pointillist" method are shown in greater detail in FIG. 7B. Droplets are placed 721 on a surface of a nail using a dispenser, e.g., a syringe style dispenser. The droplets flow 722 into each other and moisten the nail surface. The droplets then further flow 723. A flat coating is created 724 when the droplets complete flowing.

Multiple such layers of nail polish can be deposited on top of each other to create a thicker coat, or to provide a base/top coat. Colors can be changed in the middle of the application to create different patterns.

Figure 7D:
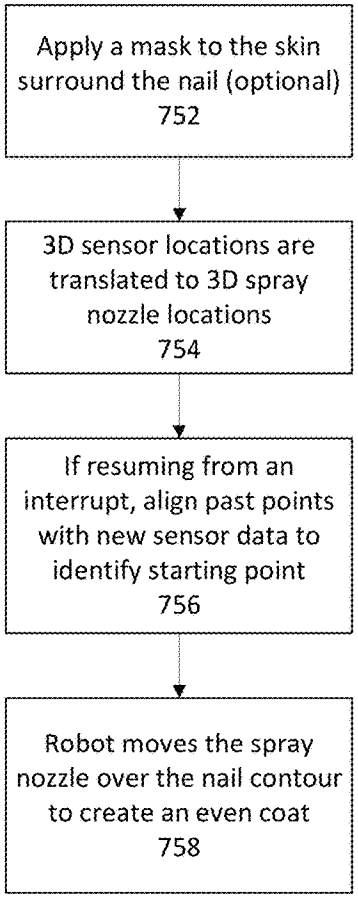
FIG. 7D is a detailed flowchart of a Spray technique for painting nails in accordance with an embodiment.
Figure 7C:
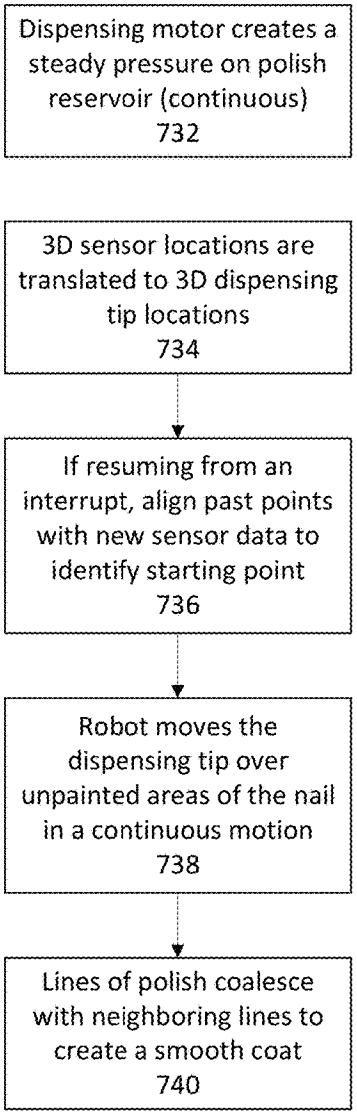
FIG. 7C is a detailed flowchart of a Pen technique for painting nails in accordance with an embodiment.

FIG. 7C is a detailed flowchart of a Pen technique for painting nails 505 in accordance with an embodiment. This pen technique involves moving the dispense tip over unpainted areas of the nail in a single fluid motion while dispensing polish continuously. The speed of motion or rate of polish dispensing can be varied to control how much polish is deposited onto different parts of the nail. The dispensing motor continuously creates 732 a steady pressure on the polish reservoir. The 3D sensor location is translated 734 to 3D dispensing trip locations. If the operation is resuming from an interrupt, e.g., a pause caused by a request, movement, and/or safety concerns, the past points are aligned 736 with sensor data to identify the starting/continuing point. The robot moves 738 the dispensing tip to over unpainted areas of the nail in a continuous motion, e.g., one continuous motion. Lines of polish coalesce 740 with neighboring lines to create a smooth coat.

FIG. 7D is a detailed flowchart of a fine spray technique for painting nails 505 in accordance with an embodiment.

In some embodiments, a mask is applied 752 around the nail, in particular on the cuticle. The mask may be applied by the user or automatically applied by the robot using the representation of the nail as a guide. The mask is a material such as liquid latex or spirit gum that can be safely applied on the user's skin and later peeled or washed off. The mask provides accuracy and precision to the application of the nail polish. 3D sensor locations, e.g., from step 503, are translated to 3D spray nozzle locations. If the operation is resuming from an interrupt, e.g., a pause caused by a request, movement, and/or safety concerns, the past points are aligned 756 with sensor data to identify the starting/continuing point. The robot moves 758 the spray nozzle over the nail contour to create an even coat. The direction and thickness of the spray is determined by the motion planner based on the representation generated by the robot. For example, the robot may spray more finely towards the edge of the nail than at the center of the nail. In some instances, after a threshold of time, the robot applies an additional spray of polish to create another coat of nail polish. The additional coat may be a different color or type of polish than the original coat of nail polish.

The robot uses the camera and other sensors throughout the application process to make decisions such as whether to keep going or abort because the user moved their position, or other critical changes to the operational environment.

Figure 8B:
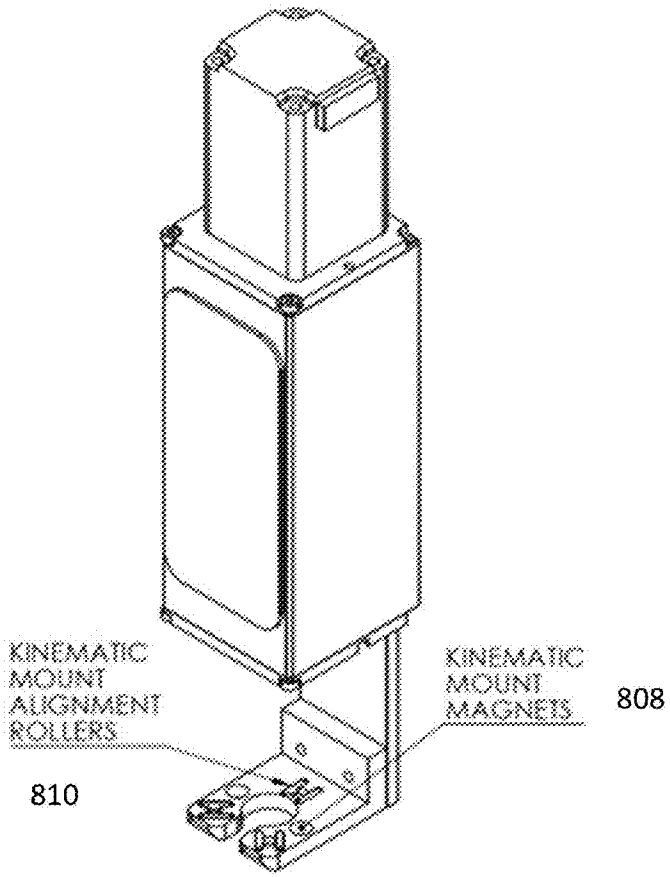
FIGS. 8A and 8B are illustrations of a magnet mount systems in accordance with an embodiment.
Figure 8A:
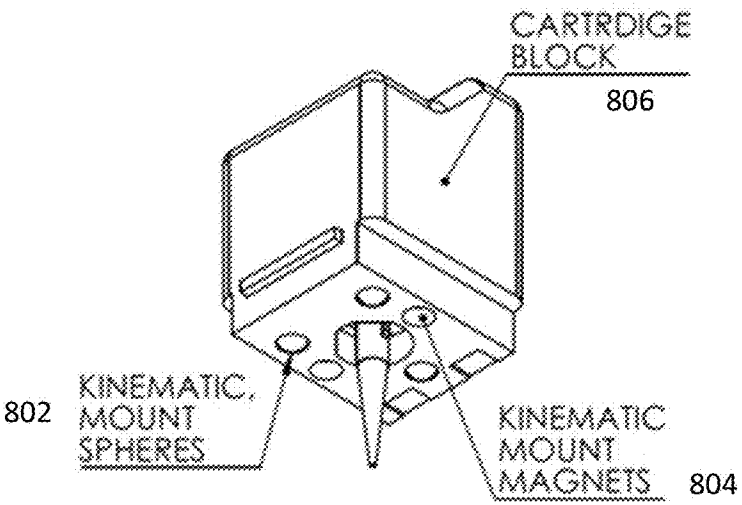

Some polish applications require more than one kind or color of polish and/or polish remover. To support these cases one embodiment of an end effector supports multiple cartridges. In alternate embodiments a "tool changing" process may be used. To allow the robot to change tools during operation without operator intervention, a repeatable pick-up and put-down system is used. FIGS. 8A and 8B are illustrations of a magnet mount system in accordance with an embodiment. One embodiment of such a system would be a magnetic "kinematic mount". The robot end effector includes an arrangement of magnets 808 and bearings or mount alignment rollers 810 designed to attract and guide a cartridge or cartridge holder 806 into the same position every time the cartridge is picked up. The cartridge or holder is fitted with a complementary set of magnets 804 and bearings or mount spheres 802. Cartridges stored for later use are picked up by moving the end effector magnets near the cartridge magnets while the bearings guide the cartridge into the correct position for use. An example of such a magnetic mount system is depicted in FIGS. 8A and 8B.

Reference in the specification to "one embodiment" or to "an embodiment" means that a particular feature, structure, or characteristic described in connection with the embodiments is included in at least one embodiment. The appearances of the phrase "in one embodiment" or "an embodiment" in various places in the specification are not necessarily all referring to the same embodiment.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic or optical signals capable of being stored, transferred, combined, compared and otherwise manipulated. It is convenient at times, principally for reasons of common usage, to refer to these signals as bits, values, elements, symbols, characters, terms, numbers, or the like. Furthermore, it is also convenient at times, to refer to certain arrangements of steps requiring physical manipulations or transformation of physical quantities or representations of physical quantities as modules or code devices, without loss of generality.

However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or "determining" or the like, refer to the action and processes of a computer system, or similar electronic computing device (such as a specific computing machine), that manipulates and transforms data represented as physical (electronic) quantities within the computer system memories or registers or other such information storage, transmission or display devices.

Certain aspects of the embodiments include process steps and instructions described herein in the form of an algorithm. It should be noted that the process steps and instructions of the embodiments can be embodied in software, firmware or hardware, and when embodied in software, could be downloaded to reside on and be operated from different platforms used by a variety of operating systems. The embodiments can also be in a computer program product which can be executed on a computing system.

The embodiments also relate to an apparatus for performing the operations herein. This apparatus may be specially constructed for the purposes, e.g., a specific computer, or it may comprise a computer selectively activated or reconfigured by a computer program stored in the computer. Such a computer program may be stored in a computer readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Memory can include any of the above and/or other devices that can store information/data/programs and can be transient or non-transient medium, where a non-transient or non-transitory medium can include memory/storage that stores information for more than a minimal duration. Furthermore, the computers referred to in the specification may include a single processor or may be architectures employing multiple processor designs for increased computing capability.

The algorithms and displays presented herein are not inherently related to any particular computer or other apparatus. Various systems may also be used with programs in accordance with the teachings herein, or it may prove convenient to construct more specialized apparatus to perform the method steps. The structure for a variety of these systems will appear from the description herein. In addition, the embodiments are not described with reference to any particular programming language. It will be appreciated that a variety of programming languages may be used to implement the teachings of the embodiments as described herein, and any references herein to specific languages are provided for disclosure of enablement and best mode.

Throughout this specification, some embodiments have used the expression "coupled" along with its derivatives. The term "coupled" as used herein is not necessarily limited to two or more elements being in direct physical or electrical contact. Rather, the term "coupled" may also encompass two or more elements are not in direct contact with each other, but yet still co-operate or interact with each other, or are structured to provide a thermal conduction path between the elements.

Likewise, as used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

In addition, use of the "a" or "an" are employed to describe elements and components of the embodiments herein. This is done merely for convenience and to give a general sense of embodiments. This description should be read to include one or at least one and the singular also includes the plural unless it is obvious that it is meant otherwise. The use of the term and/or is intended to mean any of: "both", "and", or "or."

In addition, the language used in the specification has been principally selected for readability and instructional purposes, and may not have been selected to delineate or circumscribe the inventive subject matter. Accordingly, the disclosure of the embodiments is intended to be illustrative, but not limiting, of the scope of the embodiments.

While particular embodiments and applications have been illustrated and described herein, it is to be understood that the embodiments are not limited to the precise construction and components disclosed herein and that various modifications, changes, and variations may be made in the arrangement, operation, and details of the methods and apparatuses of the embodiments without departing from the spirit and scope of the embodiments.

What is claimed is:

1. A system for automatically polishing a nail of a user including:

an end-effector having a cartridge receiving unit, a cartridge including nail polish, and a nozzle;

a three-dimensional sensor, to capture images of the nail of the user;

a nail determination unit, receiving said images, to automatically determine three dimensional coordinates corresponding to the nail of the user using artificial intelligence (AI);

a motion planning unit, for automatically generating a motion path for said end-effector to position said end-effector based on the three dimensional coordinates corresponding to the nail of the user such that said nozzle is directed over unpainted areas of the nail of the user;

a motion platform, to automatically move said end-effector in three dimensions in accordance with the motion path; and a dispensing unit to automatically dispense nail polish in said cartridge through said nozzle onto the nail of the user as the motion platform moves.

2. The system of claim 1, further comprising:

a safety module, receiving signals from said nail determination unit, to determine when a position of the nail has moved and to stop said dispensing unit from dispensing nail polish if said position of the nail has moved.

3. The system of claim 2, wherein said safety module, determines whether the position of the nail has moved by comparing the position of the nail at a first and second time and identifying that the nail has moved if the position of the nail at said second time is greater that a first threshold distance away from the position of the nail at said first time.

4. The system of claim 1, wherein said dispensing unit includes a pressure application unit to apply a first pressure to said polish to generate a first flow rate of said polish through said nozzle.

5. The system of claim 1, further comprising a nail treatment plan input module, for receiving a selection of a type of nail polish treatment and transmitting treatment information associated with the selected type of nail polish treatment to said dispensing unit.

6. The system of claim 5, wherein said nail treatment input module is positioned on said system for automatically polishing the nail.

7. The system of claim 5, wherein said nail treatment input module is an application that can operate on a remote device that is at least one of a phone, watch, computing device, or wearable.

8. The system of claim 5, wherein said polish treatment can include one or more of a single-color coat polish, a two-tone color coat polish, a two-tone vertical split nail art polish, a two tone-horizontal blended nail art polish, a colored tips nail polish, a multi-colored polish on different nails, a French manicure, and a regular lacquer polish.

9. The method of claim 1, wherein the motion path is generated to paint an entire area of the nail of the user.

10. The method of claim 1, wherein the nail determination unit is trained based on labelled images of nails from different users to identify the nail of the user in the received said images and determine portions of the nail that needs to be painted.

11. The method of claim 1, wherein the motion planning unit receives the three dimensional coordinates and generates the motion path based on the three dimensional coordinates in real-time using AI.

12. A method for automatically polishing a nail of user including the steps of:

automatically determining three dimensional coordinates corresponding to the nail of the user using AI;

automatically moving, along three dimensions, a nozzle that is coupled to a cartridge having first nail polish to a first position such that said nozzle is directed over unpainted areas of the nail of the user; and automatically dispensing said first nail polish on said nail as the nozzle moves.

13. The method of claim 12, further comprising the step of:

determining when a position of the nail has moved, and stopping said dispensing unit from dispensing the first nail polish if said position of the nail has moved.

14. The method of claim 13, wherein determining whether the position of the nail has moved includes the steps of:

comparing the position of the nail at a first and second time; and identifying that the nail has moved if the position of the nail at said second time is greater that a first threshold distance away from the position of the nail at said first time.

15. The method of claim 12, further comprising the step of applying a first pressure to said first polish to generate a first flow rate of said first polish through said nozzle.

16. The method of claim 12, further comprising the step of automatically generating a motion path for moving said nozzle in three dimensions.

17. The method of claim 12, further comprising the steps of:

receiving a selection of a type of nail polish treatment from the user;

determining treatment information about the selected type of nail polish treatment; and transmitting said treatment information to a dispensing unit configured to automatically dispense the first nail polish.

18. The method of claim 17, wherein said selection of the type of nail polish treatment is received from an application that can operate on a remote device.

19. The method of claim 18, wherein said remote device is at least one of a phone, watch, computing device, or wearable.

20. The method of claim 17, wherein said polish treatment can include one or more of a single-color coat polish, a two-tone color coat polish, a two-tone vertical split nail art polish, a two tone-horizontal blended nail art polish, a colored tips nail polish, a multi-colored polish on different nails, a French manicure, and a regular lacquer polish.

* * * * *